US008783912B2

(12) United States Patent
Yang

(10) Patent No.: US 8,783,912 B2
(45) Date of Patent: Jul. 22, 2014

(54) CUP-SHAPED HEAT DISSIPATER HAVING HEAT CONDUCTIVE RIB AND FLOW GUIDE HOLE AND APPLIED IN ELECTRIC LUMINOUS BODY

(76) Inventor: Tai-Her Yang, Dzan-Hwa (TW)

( * ) Notice: Subject to any disclaimer, the term of this patent is extended or adjusted under 35 U.S.C. 154(b) by 0 days.

(21) Appl. No.: 13/554,121

(22) Filed: Jul. 20, 2012

(65) Prior Publication Data

US 2014/0022801 A1 Jan. 23, 2014

(51) Int. Cl.
*F21V 29/00* (2006.01)

(52) U.S. Cl.
USPC ..... 362/294; 313/46

(58) Field of Classification Search
USPC ..... 362/294, 236; 313/46
See application file for complete search history.

*Primary Examiner* — Anne Hines
(74) *Attorney, Agent, or Firm* — Bacon & Thomas, PLLC

(57) ABSTRACT

The present invention provides a cup-shaped heat dissipater having heat conductive rib and flow guide hole, in which the outer cup bottom of the cup-shaped heat dissipater (100) is formed as a planar or convex or concave surface for accommodating the electric luminous body (200), so with the heat dissipation surface formed opposite to the cup-shaped inner recessed structure of the heat dissipater (100) and with the heat conductive rib structure (310) connecting between the inner periphery of the cup-shaped inner recessed structure of the heat dissipater (100) and the heat source zone having its bottom being installed with the electric luminous body (200) and the solid or tubular central column (103), the heat in the central heat source zone can be dissipated to the periphery through the surface of the heat conductive rib structure (310) and the surface of the heat dissipater (100).

20 Claims, 3 Drawing Sheets

CUP-SHAPED HEAT DISSIPATER HAVING HEAT CONDUCTIVE RIB AND FLOW GUIDE HOLE AND APPLIED IN ELECTRIC LUMINOUS BODY

BACKGROUND OF THE INVENTION (a) Field of the Invention

The present invention provides a novel cup-shaped heat dissipater having heat conductive rib and flow guide hole for meeting the heat dissipation requirement of an electric luminous body, e.g. the heat dissipation requirement of a light emitting diode (LED) which is adopted as the electric luminous body (200); the outer cup bottom of the cup-shaped heat dissipater (100) is formed as a planar or convex or concave surface for accommodating the electric luminous body (200), so the heat generated by the electric luminous body (200) can be dissipated to the exterior from the surface of the heat dissipater (100), with the enlarged heat dissipation surface formed in the cup-shaped inner recessed structure of the heat dissipater (100) opposite to the installation location of the electric luminous body (200), the heat can also be directly dissipated through the larger heat dissipation area, and with the heat conductive rib structure (310) oppositely formed in the cup-shaped inner recessed structure of the heat dissipater (100) and combined between the inner periphery of the cup-shaped inner recessed structure of the heat dissipater (100) and the heat source zone having its bottom being installed with the electric luminous body (200) and the solid or tubular central column (103), the heat in the central heat source zone can be dissipated to the periphery through the surface of the heat conductive rib structure (310) and the surface of the heat dissipater (100), furthermore, flow guide holes allowing airflow to pass are formed on the heat dissipater (100) for performing heat dissipating convection through the heat dissipating fluid.

(b) Description of the Prior Art

A conventional heat dissipation device applicable in the electric luminous body (200) of an electric illumination device, e.g. the heat dissipater used in a LED illumination device, usually transmits the heat generated by the LED to the heat dissipater then dissipates the heat to the exterior through the surface of the heat dissipater, thereby limiting the heat dissipation area.

SUMMARY OF THE INVENTION

The present invention provides a novel cup-shaped heat dissipater having heat conductive rib and flow guide hole for meeting the heat dissipation requirement of an electric luminous body, e.g. the heat dissipation requirement of a light emitting diode (LED) which is adopted as the electric luminous body (200); the outer cup bottom of the cup-shaped heat dissipater (100) is formed as a planar or convex or concave surface for accommodating the electric luminous body (200), so the heat generated by the electric luminous body (200) can be dissipated to the exterior from the surface of the heat dissipater (100), with the enlarged heat dissipation surface formed in the cup-shaped inner recessed structure of the heat dissipater (100) opposite to the installation location of the electric luminous body (200), the heat can also be directly dissipated through the larger heat dissipation area, and further with the heat conductive rib structure (310) oppositely formed in the cup-shaped inner recessed structure of the heat dissipater (100), combined between the inner periphery of the cup-shaped inner recessed structure of the heat dissipater (100), the heat source zone having its bottom being installed with the electric luminous body (200), and the solid or tubular central column (103), the heat in the central heat source zone can be dissipated to the periphery through the surface of the heat conductive rib structure (310) and the surface of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes (302), which axially penetrate the central column (103), at the center of the cup bottom surface (120); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

DESCRIPTION OF MAIN COMPONENT SYMBOLS

Figure 1:
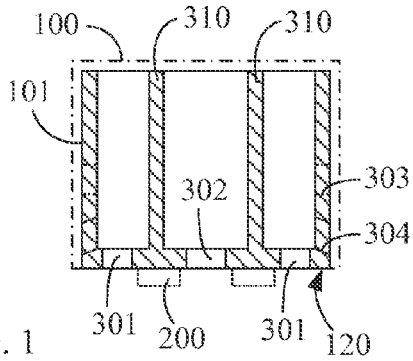
FIG. 1 is a cross sectional view showing the basic structure of the heat dissipater (100), according to the present invention.

100: Heat dissipater
101: Surface of heat dissipater
103: Central column
105: Tooth notch
106: Fork-shaped annular structure
109: Protection net
110: Top cover
111: Support column
112: Ventilation port
120: Cup bottom surface
200: Electric luminous body
301: Flow guide hole annularly arranged at the bottom periphery
302: Flow guide hole
303: Radial flow guide hole
304: Inclined flow guide hole at bottom corner
310: Heat conductive rib structure

DETAILED DESCRIPTION OF THE PREFERRED EMBODIMENTS

A conventional heat dissipation device applicable in the electric luminous body (200) of an electric illumination device, e.g. the heat dissipater used in a LED illumination device, usually transmits the heat generated by the LED to the heat dissipater then dissipates the heat to the exterior through the surface of the heat dissipater, thereby limiting the heat dissipation area.

The present invention provides a novel cup-shaped heat dissipater having heat conductive rib and flow guide hole for meeting the heat dissipation requirement of an electric luminous body, e.g. the heat dissipation requirement of a light emitting diode (LED) which is adopted as the electric luminous body (200); the outer cup bottom of the cup-shaped heat dissipater (100) is formed as a planar or convex or concave surface for accommodating the electric luminous body (200), so the heat generated by the electric luminous body (200) can be dissipated to the exterior from the surface of the heat dissipater (100), with the enlarged heat dissipation surface formed in the cup-shaped inner recessed structure of the heat dissipater (100) opposite to the installation location of the electric luminous body (200), the heat can also be directly dissipated through the larger heat dissipation area, and further with the heat conductive rib structure (310) oppositely formed in the cup-shaped inner recessed structure of the heat dissipater (100), combined between the inner periphery of the cup-shaped inner recessed structure of the heat dissipater (100), the heat source zone having its bottom being installed with the electric luminous body (200), and the solid or tubular central column (103), the heat in the central heat source zone can be dissipated to the periphery through the surface of the heat conductive rib structure (310) and the surface of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes (302), which axially penetrate the central column (103), at the center of the cup bottom surface (120); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 2:
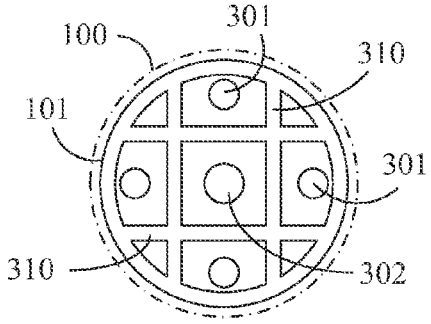
FIG. 2 is a top view of FIG. 1.

FIG. 1 is a cross sectional view showing the basic structure of the heat dissipater (100), according to the present invention;

FIG. 2 is a top view of FIG. 1 taken along the A-A cross section;

As shown in FIG. 1 and FIG. 2, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours; the surface of one or both of the cup periphery and/or the inner annular surface of the heat dissipater (100) is formed as a planar or wavelike structure or formed as a structure having heat dissipation fins;

heat conductive rib structure (310): made by materials having great heat conductivity, integrally formed or assembled with the heat dissipater (100), the heat conductive rib structure (310) is formed as a central radially extended or formed in a multiple grid state having three or more sides (formed in a rectangular grid state shown in FIG. 1 according to one embodiment), disposed in the cup-shaped inner recessed structure, combined between the inner periphery of the cup-shaped inner recessed structure of the heat dissipater (100) and the heat source zone having its bottom being installed with the electric luminous body (200) and the heat conductive rib structure (310) formed in the multiple grid state, used for transferring heat;

the outer cup bottom of the cup-shaped heat dissipater is formed as a planar or convex or concave surface for accommodating the electric luminous body (200), so the heat generated by the electric luminous body (200) can be dissipated to the exterior from the surface of the heat dissipater, and further with the enlarged heat dissipation surface formed in the cup-shaped inner recessed structure opposite to the installation location of the electric luminous body (200), the heat can also be directly dissipated through the larger heat dissipation area, and with the heat conductive rib structure (310) oppositely formed in the cup-shaped inner recessed structure of the heat dissipater (100) and combined between the inner periphery of the cup-shaped inner recessed structure of the heat dissipater (100) and the heat source zone having its bottom being installed with the electric luminous body (200) and the heat conductive rib structure (310) formed in the multiple grid state, the heat in the central heat source zone can be dissipated to the periphery through the surface of the heat conductive rib structure (310) and the surface of heat dissipater (101), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes (302) at the center of the cup bottom surface (120) (as shown in FIG. 1); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 3:
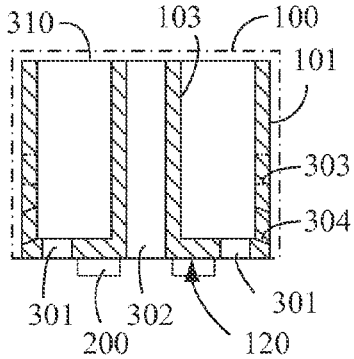
FIG. 3 is a cross sectional view illustrating the cup-shaped structure formed in the heat dissipater (100) opposite to the installation location of the electric luminous body (200) being formed with a single annular cup-shaped inner recessed structure, according to the present invention.
Figure 4:
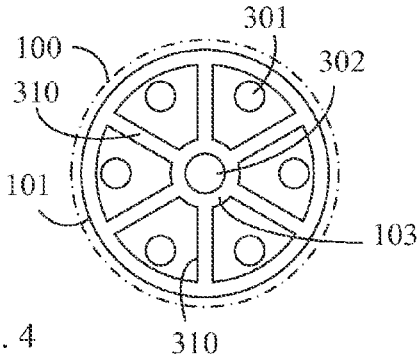
FIG. 4 is a top view of FIG. 3.
Figure 19:
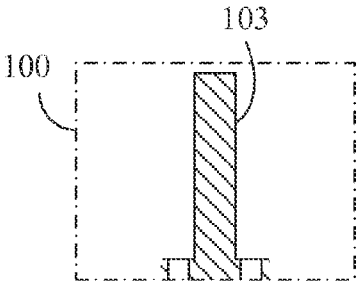
FIG. 19 is a schematic structural view illustrating the central column (103) being composed as a solid central column, according to one embodiment of the present invention.

FIG. 3 is a cross sectional view illustrating the cup-shaped structure formed in the heat dissipater (100) opposite to the installation location of the electric luminous body (200) being formed with a single annular cup-shaped inner recessed structure, according to the present invention;

FIG. 4 is a top view of FIG. 3;

As shown in FIG. 3 and FIG. 4, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours; wherein one surface of the heat dissipater (100) is installed with the electric luminous body (200), the other surface of the heat dissipater (100) is formed with the single cup-shaped inner recessed structure and a central column (103); the surface of one or both of the cup periphery and/or the inner annular surface of the heat dissipater (100) is formed as a planar or wavelike structure or formed as a structure having heat dissipation fins;

heat conductive rib structure (310): made by materials having great heat conductivity, integrally formed or assembled with the heat dissipater (100), the heat conductive rib structure (310) is formed in a strip or sheet state, disposed in the cup-shaped inner recessed structure, combined between the inner periphery of the cup-shaped inner recessed structure of the heat dissipater (100) and the heat source zone having its bottom being installed with the electric luminous body (200) and the tubular central column (103) (as shown in FIG. 3) or the solid central column (103) (as shown in FIG. 19), used for transferring heat;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the single cup-shaped inner recessed structure formed on the other surface of the heat dissipater (100), the central column (103) and the surface of heat dissipater (101), and further with the heat conductive rib structure (310) oppositely formed in the cup-shaped inner recessed structure of the heat dissipater (100), combined between the inner periphery of the cup-shaped inner recessed structure of the heat dissipater (100), the heat source zone having its bottom being installed with the electric luminous body (200), and the solid or tubular central column (103), the heat in the central heat source zone can be dissipated to the periphery through the surface of the heat conductive rib structure (310) and the surface of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes (302), which axially penetrate the central column (103), at the center of the cup bottom surface (120) (as shown in FIG. 3); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 5:
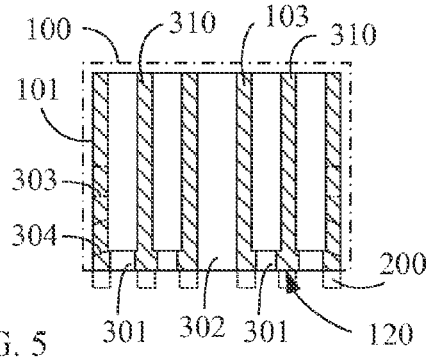
FIG. 5 is a cross sectional view illustrating the cup-shaped structure formed in the heat dissipater (100) opposite to the installation location of the electric luminous body (200) being formed with a multiple annular cup-shaped inner recessed structure, according to the present invention.
Figure 6:
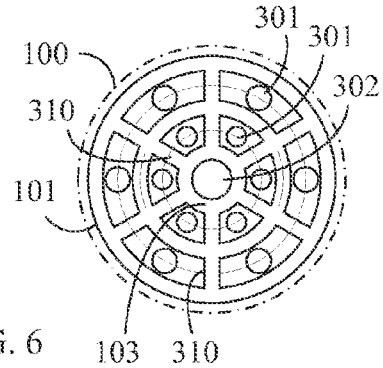
FIG. 6 is a top view of FIG. 5.

FIG. 5 is a cross sectional view illustrating the cup-shaped structure formed in the heat dissipater (100) opposite to the installation location of the electric luminous body (200) being formed with a multiple annular cup-shaped inner recessed structure, according to the present invention;

FIG. 6 is a top view of FIG. 5;

As shown in FIG. 5 and FIG. 6, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours; wherein one surface of the heat dissipater (100) is installed with the electric luminous body (200), and the other surface of the heat dissipater (100) is formed with two or more cup-shaped inner recessed structures and the central column (103) and two or more layers of surfaces of heat dissipater (101); the surface of one or both of the cup periphery and/or the inner annular surface of the heat dissipater (100) is formed as a planar or wavelike structure or formed as a structure having heat dissipation fins;

heat conductive rib structure (310): made by materials having great heat conductivity, integrally formed or assembled with the heat dissipater (100), the heat conductive rib structure (310) is formed in a strip or sheet state, disposed in the cup-shaped inner recessed structure, combined between the inner periphery of the cup-shaped inner recessed structure of the heat dissipater (100), the heat source zone having its bottom being installed with the electric luminous body (200), and the tubular central column (103) (as shown in FIG. 5) or the solid central column (103) (as shown in FIG. 19), used for transferring heat;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the two or more cup-shaped inner recessed structures formed on the other surface of the heat dissipater (100), the central column (103) and two or more layers of surfaces of heat dissipater (101), and further with the heat conductive rib structure (310) oppositely formed in the cup-shaped inner recessed structure of the heat dissipater (100) and combined between the inner periphery of the cup-shaped inner recessed structure of the heat dissipater (100) and the heat source zone having its bottom being installed with the electric luminous body (200) and the solid or tubular central column (103), the heat in the central heat source zone can be dissipated to the periphery through the surface of the heat conductive rib structure (310) and the surface of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes (302), which axially penetrate the central column (103), at the center of the cup bottom surface (120) (as shown in FIG. 5); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 7:
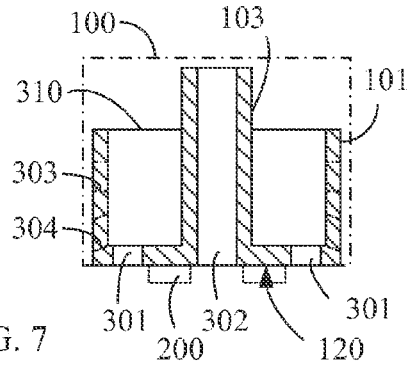
FIG. 7 is a cross sectional view illustrating the cup-shaped structure formed in the heat dissipater (100) opposite to the installation location of the electric luminous body (200) being formed with a single annular cup-shaped inner recessed structure and a stepped structure having the higher central column (103) and the lower outer periphery, according to the present invention.
Figure 8:
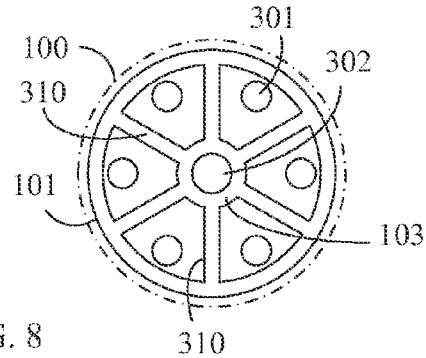
FIG. 8 is a top view of FIG. 7.

FIG. 7 is a cross sectional view illustrating the cup-shaped structure formed in the heat dissipater (100) opposite to the installation location of the electric luminous body (200) being formed with a single annular cup-shaped inner recessed structure and a stepped structure having the higher central column (103) and the lower outer periphery, according to the present invention;

FIG. 8 is a top view of FIG. 7;

As shown in FIG. 7 and FIG. 8, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200), and the other surface of the heat dissipater (100) is formed with the single cup-shaped inner recessed structure and a higher central column (103), thereby forming a stepped structure having the higher central column (103) and the lower outer periphery; the surface of one or both of the cup periphery and/or the inner annular surface of the heat dissipater (100) is formed as a planar or wavelike structure or formed as a structure having heat dissipation fins;

heat conductive rib structure (310): made by materials having great heat conductivity, integrally formed or assembled with the heat dissipater (100), the heat conductive rib structure (310) is formed in a strip or sheet state, disposed in the cup-shaped inner recessed structure, combined between the inner periphery of the cup-shaped inner recessed structure of the heat dissipater (100), the heat source zone having its bottom being installed with the electric luminous body (200), and the tubular central column (103) (as shown in FIG. 7) or the solid central column (103) (as shown in FIG. 19), used for transferring heat;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the single cup-shaped inner recessed structure formed on the other surface of the heat dissipater (100) and the higher central column (103), thereby forming a stepped structure having the higher central column (103) and the lower outer periphery and the surface of heat dissipater (101), and further with the heat conductive rib structure (310) oppositely formed in the cup-shaped inner recessed structure of the heat dissipater (100), combined between the inner periphery of the cup-shaped inner recessed structure of the heat dissipater (100), the heat source zone having its bottom being installed with the electric luminous body (200) and the solid or tubular central column (103), the heat in the central heat source zone can be dissipated to the periphery through the surface of the heat conductive rib structure (310) and the surface of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes (302), which axially penetrate the central column (103), at the center of the cup bottom surface (120) (as shown in FIG. 7); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 9:
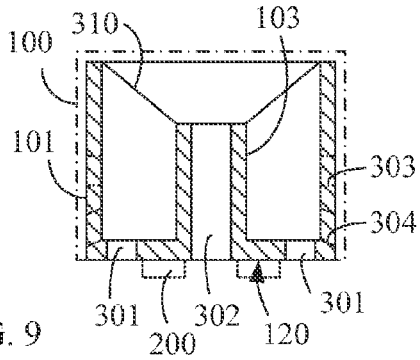
FIG. 9 is another cross sectional view illustrating the cup-shaped structure formed in the heat dissipater (100) opposite to the installation location of the electric luminous body (200) being formed with a single annular cup-shaped inner recessed structure and a stepped structure having the lower central column (103) and the higher outer periphery, according to the present invention.
Figure 10:
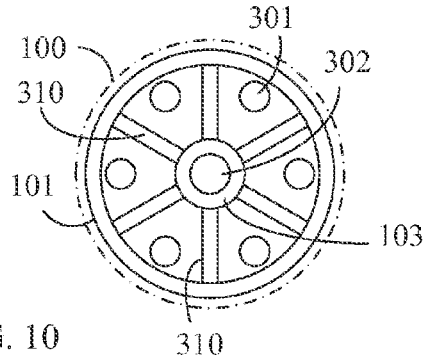
FIG. 10 is a top view of FIG. 9.

FIG. 9 is another cross sectional view illustrating the cup-shaped structure formed in the heat dissipater (100) opposite to the installation location of the electric luminous body (200) being formed with a single annular cup-shaped inner recessed structure and a stepped structure having the lower central column (103) and the higher outer periphery, according to the present invention;

FIG. 10 is a top view of FIG. 9;

As shown in FIG. 9 and FIG. 10, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200) and the other surface of the heat dissipater (100) is formed with the single cup-shaped inner recessed structure and a lower central column (103), thereby forming a stepped structure having the lower central column (103) and the higher outer periphery; the surface of one or both of the cup periphery and/or the inner annular surface of the heat dissipater (100) is formed as a planar or wavelike structure or formed with a structure having heat dissipation fins;

heat conductive rib structure (310): made by materials having great heat conductivity, integrally formed or assembled with the heat dissipater (100), the heat conductive rib structure (310) is formed in a strip or sheet state, disposed in the cup-shaped inner recessed structure, combined between the inner periphery of the cup-shaped inner recessed structure of the heat dissipater (100) and the heat source zone having its bottom being installed with the electric luminous body (200) and the tubular central column (103) (as shown in FIG. 9) or the solid central column (103) (as shown in FIG. 19), used for transferring heat;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the single cup-shaped inner recessed structure formed on the other surface of the heat dissipater (100) and the lower central column (103), thereby forming a stepped structure having the lower central column (103) and the higher outer periphery and the surface of heat dissipater (101), and further with the heat conductive rib structure (310) oppositely formed in the cup-shaped inner recessed structure of the heat dissipater (100), combined between the inner periphery of the cup-shaped inner recessed structure of the heat dissipater (100) and the heat source zone having its bottom being installed with the electric luminous body (200) and the solid or tubular central column (103), the heat in the central heat source zone can be dissipated to the periphery through the surface of the heat conductive rib structure (310) and the surface of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes (302), which axially penetrate the central column (103), at the center of the cup bottom surface (120) (as shown in FIG. 9); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 11:
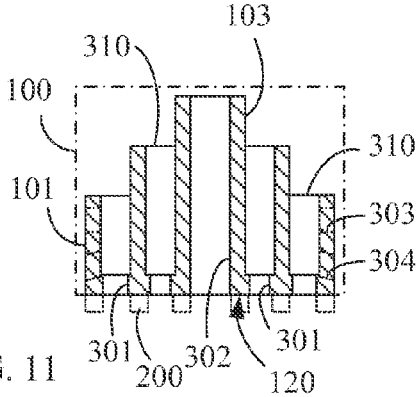
FIG. 11 is one another cross sectional view illustrating the cup-shaped structure formed in the heat dissipater (100) opposite to the installation location of the electric luminous body (200) being formed with a multiple annular cup-shaped inner recessed structure and a multiple stepped structure having the higher central column (103) and the lower multiple annular outer periphery, according to the present invention.
Figure 12:
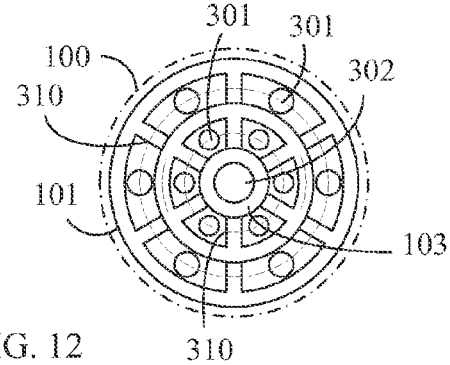
FIG. 12 is a top view of FIG. 11.

FIG. 11 is one another cross sectional view illustrating the cup-shaped structure formed in the heat dissipater (100) opposite to the installation location of the electric luminous body (200) being formed with a multiple annular cup-shaped inner recessed structure and a multiple stepped structure having the higher central column (103) and the lower multiple annular outer periphery, according to the present invention;

FIG. 12 is a top view of FIG. 11;

As shown in FIG. 11 and FIG. 12, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200), and the other surface of the heat dissipater (100) is formed with two or more multiple annular cup-shaped inner recessed structures and a central column (103) and two or more layers of surfaces of heat dissipater (101), thereby forming a multiple stepped structure having the higher central column (103) and the lower multiple annular outer periphery; the surface of one or both of the cup periphery and/or the inner annular surface of the heat dissipater (100) is formed as a planar or wavelike structure or formed as a structure having heat dissipation fins;

heat conductive rib structure (310): made by materials having great heat conductivity, integrally formed or assembled with the heat dissipater (100), and the heat conductive rib structure (310) is formed in a strip or sheet state, disposed in the cup-shaped inner recessed structure, combined between the inner periphery of the cup-shaped inner recessed structure of the heat dissipater (100) and the inner annular heat dissipater, and the heat source zone having its bottom being installed with the electric luminous body (200) and the tubular central column (103) (as shown in FIG. 11) or the solid central column (103) (as shown in FIG. 19), used for transferring heat;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by two or more cup-shaped inner recessed structures formed on the other surface of the heat dissipater (100), the central column (103), and two or more layers of surfaces of heat dissipater (101), thereby forming a multiple stepped structure having the higher central column (103) and the lower multiple annular outer periphery, and further with the heat conductive rib structure (310) oppositely formed in the cup-shaped inner recessed structure of the heat dissipater (100), combined between the inner periphery of the cup-shaped inner recessed structure of the heat dissipater (100) and the heat source zone having its bottom being installed with the electric luminous body (200) and the solid or tubular central column (103), the heat in the central heat source zone can be dissipated to the exterior through the surface of the heat conductive rib structure (310) and the surface of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes (302), which axially penetrate the central column (103), at the center of the cup bottom surface (120) (as shown in FIG. 11); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120);

the mentioned heat dissipater (100) further includes that the cup-shaped structure formed in the heat dissipater (100) opposite to the installation location of the electric luminous body (200) has two or more cup-shaped inner recessed structures and a central column (103) and two or more layers of surfaces of heat dissipater (101), thereby forming a multiple-stepped structure having the higher outer periphery.

Figure 13:
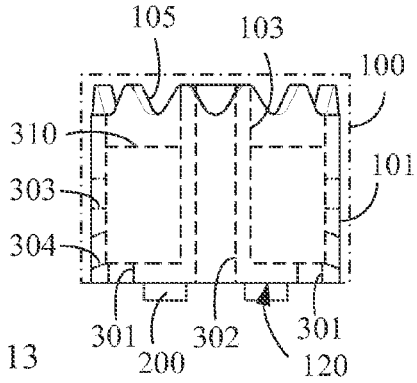
FIG. 13 is a schematic lateral view illustrating the upper periphery of the cup-shaped structure formed in the heat dissipater (100) opposite to the installation location of the electric luminous body (200) being formed with a crown-like tooth notch (105) and formed with a central column (103) and a heat conductive rib structure (310), according to the present invention.
Figure 14:
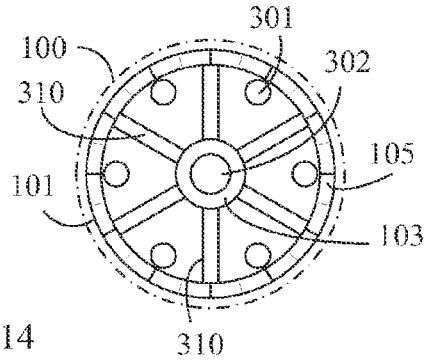
FIG. 14 is a top view of FIG. 13.

FIG. 13 is a schematic lateral view illustrating the upper periphery of the cup-shaped structure formed in the heat dissipater (100) opposite to the installation location of the electric luminous body (200) being formed with a crown-like tooth notch (105) and formed with a central column (103) and a heat conductive rib structure (310), according to the present invention;

FIG. 14 is a top view of FIG. 13;

As shown in FIG. 13 and FIG. 14, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200), and the other surface of the heat dissipater (100) is formed with the cup-shaped inner recessed structure having an annular structure with crown-like tooth notch (105) at the upper periphery and a central column (103), thereby forming a structure of the central column (103) and the annular structure with the crown-like tooth notch (105) at the periphery being at the same or different height; the surface of one or both of the cup periphery and/or the inner annular surface of the heat dissipater (100) is formed as a planar or wave-like structure or formed as a structure having heat dissipation fins;

heat conductive rib structure (310): made by materials having great heat conductivity, integrally formed or assembled with the heat dissipater (100), the heat conductive rib structure (310) is formed in a strip or sheet state, disposed in the cup-shaped inner recessed structure, combined between the inner periphery of the cup-shaped inner recessed structure of the heat dissipater (100) and the heat source zone having its bottom being installed with the electric luminous body (200) and the tubular central column (103) (as shown in FIG. 13) or the solid central column (103) (as shown in FIG. 19), used for transferring heat;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the cup-shaped inner recessed structure having the annular structure with the crown-like tooth notch (105) at the upper periphery formed on the other surface of the heat dissipater (100), the central column (103) and the surface of heat dissipater (101), and further with the heat conductive rib structure (310) oppositely formed in the cup-shaped inner recessed structure of the heat dissipater (100), combined between the inner periphery of the cup-shaped inner recessed structure of the heat dissipater (100) and the heat source zone having its bottom being installed with the electric luminous body (200) and the solid or tubular central column (103), the heat in the central heat source zone can be dissipated to the periphery through the surface of the heat conductive rib structure (310) and the surface of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes (302), which axially penetrate the central column (103), at the center of the cup bottom surface (120) (as shown in FIG. 13); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120).

Figure 15:
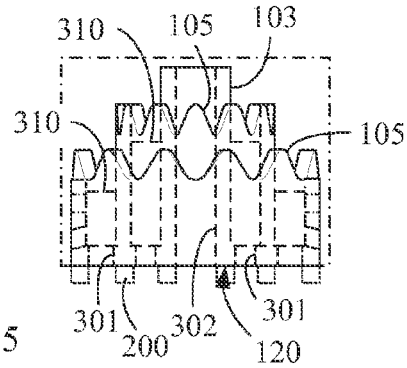
FIG. 15 is another schematic lateral view illustrating the upper periphery of the cup-shaped structure formed in the heat dissipation member (100) opposite to the installation location of the electric-powered light emitting unit (200) being formed with multiple crown-like tooth notch (105) and a structure having the higher central column (103) and the lower outer periphery, according to the present invention.
Figure 16:
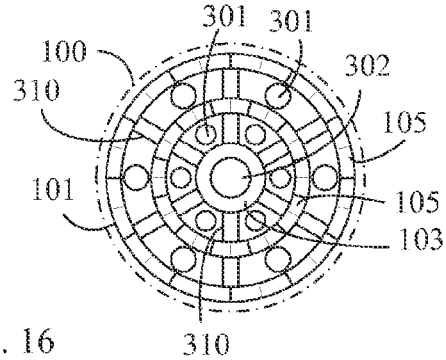
FIG. 16 is a top view of FIG. 15.

FIG. 15 is another schematic lateral view illustrating the upper periphery of the cup-shaped structure formed in the heat dissipation member (100) opposite to the installation location of the electric-powered light emitting unit (200) being formed with multiple crown-like tooth notch (105) and a structure having the higher central column (103) and the lower outer periphery, according to the present invention;

FIG. 16 is a top view of FIG. 15;

As shown in FIG. 15 and FIG. 16, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200), and the other surface of the heat dissipater (100) is formed with the cup-shaped inner recessed structure having the multiple crown-like tooth notch (105) at the upper periphery and a central column (103), thereby forming a multiple annular structure having the higher central column (103) and the lower crown-like tooth notch (105) at the outer periphery; the surface of one or both of the cup periphery and/or the inner annular surface of the heat dissipater (100) is formed as a planar or wavelike structure or formed as a structure having heat dissipation fins;

heat conductive rib structure (310): made by materials having great heat conductivity, integrally formed or assembled with the heat dissipater (100), the heat conductive rib structure (310) is formed in a strip or sheet state, disposed in the cup-shaped inner recessed structure, combined between the inner periphery of the cup-shaped inner recessed structure of the heat dissipater (100) and the annular structure having crown-like tooth notch therein, and the heat source zone having its bottom being installed with the electric luminous body (200) and the tubular central column (103) (as shown in FIG. 15) or the solid central column (103) (as shown in FIG. 19), used for transferring heat;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the multiple annular structure having the higher central column (103) and the lower crown-like tooth notch (105) at the outer periphery formed at the upper periphery of cup-shaped inner recessed structure at the other surface of the heat dissipater (100) and the surface of heat dissipater (101) of the heat dissipater, and further with the heat conductive rib structure (310) oppositely formed in the cup-shaped inner recessed structure of the heat dissipater (100), combined between the inner periphery of the cup-shaped inner recessed structure of the heat dissipater (100) and the heat source zone having its bottom being installed with the electric luminous body (200) and the solid or tubular central column (103), the heat in the central heat source zone can be dissipated to the periphery through the surface of the heat conductive rib structure (310) and the surface of the heat dissipater (100), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes (302), which axially penetrate the central column (103), at the center of the cup bottom surface (120) (as shown in FIG. 15); (c) installing one or more radial flow guide holes (303) in the heat dissipater (100); (d) installing one or more inclined flow guide holes at bottom corner (304) at the annular corner formed between the annular heat dissipater bottom of the heat dissipater (100) and the cup bottom surface (120);

the mentioned heat dissipater (100) further includes that the upper periphery of the cup-shaped structure formed in the heat dissipater (100) opposite to the installation location of the electric luminous body (200) has multiple crown-like tooth notches (105) and a central column (103), thereby forming a structure having the lower central column (103) and the higher multiple annular structure having the crown-like tooth notches (105) at the outer periphery;

the multiple annular structure of the mentioned multiple crown-like tooth notches (105) is defined as two or more layers.

Figure 17:
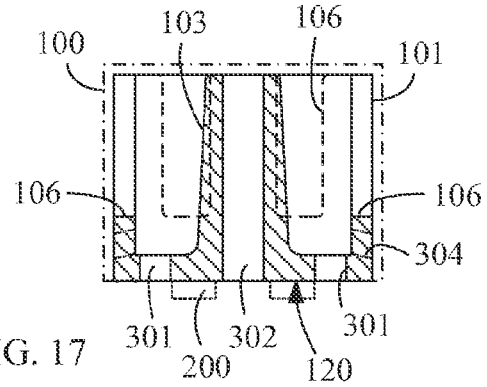
FIG. 17 is a cross sectional view illustrating the heat dissipater (100) opposite to the installation location of the electric luminous body (200) being installed with a conical column member and the cup-shaped structure being formed as a fork-shaped annular structure, according to the present invention.
Figure 18:
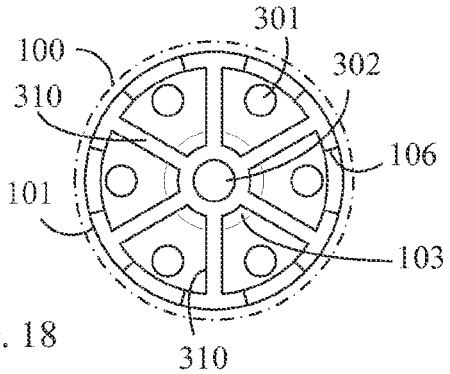
FIG. 18 is a top view of FIG. 17.

FIG. 17 is a cross sectional view illustrating the heat dissipater (100) opposite to the installation location of the electric luminous body (200) being installed with a conical column member and the cup-shaped structure being formed as a fork-shaped annular structure, according to the present invention;

FIG. 18 is a top view of FIG. 17;

As shown in FIG. 17 and FIG. 18, it mainly consists of:

heat dissipater (100): formed as a circular, oval or polygonal cup-shaped or cup-like structure, made of materials having great heat conductivity and heat dissipation property such as aluminum and copper, integrally formed or assembled by plural pieces; including parallel or conical or reverse-conical cup body contours, wherein one surface of the heat dissipater (100) is installed with the electric luminous body (200), and the other surface of the heat dissipater (100) is formed with the cup-shaped inner recessed structure having the fork-shaped annular structure (106) and the conical central column (103); the surface of one or both of the cup periphery and/or the inner annular surface of the heat dissipater (100) is formed as a planar or wavelike structure or formed as a structure having heat dissipation fins;

heat conductive rib structure (310): made by materials having great heat conductivity, integrally formed or assembled with the heat dissipater (100), the heat conductive rib structure (310) is formed in a strip or sheet state, disposed in the cup-shaped inner recessed structure, combined between the inner periphery of the cup-shaped inner recessed structure of the fork-shaped annular structure (106) of the heat dissipater (100), and the heat source zone having its bottom being installed with the electric luminous body (200), and the tubular central column (103) (as shown in FIG. 17) or the solid central column (103) (as shown in FIG. 19), used for transferring heat;

the outer cup bottom of the cup-shaped heat dissipater is formed as a planar or convex or concave surface for accommodating the electric luminous body (200), so the heat generated by the electric luminous body (200) can be directly dissipated to the exterior through a larger heat dissipation area defined by the cup-shaped inner recessed structure being formed as the fork-shaped annular structure (106) and installed with the conical central column (103) and the surface of heat dissipater (101), and further with the heat conductive rib structure (310) oppositely formed in the cup-shaped inner recessed structure of the heat dissipater (100), combined between the inner periphery of the fork-shaped annular structure (106), the heat source zone having its bottom being installed with the electric luminous body (200), and the solid or tubular central column (103), the heat in the central heat source zone can be dissipated to the periphery through the surface of the heat conductive rib structure (310)

and the surface of the fork-shaped annular structure (106), furthermore, flow guide holes allowing airflow to pass are formed on the heat dissipater (100), and the installation location of flow guide hole includes one or more than one of the followings: (a) annularly installing one or more flow guide holes annularly arranged at the bottom periphery (301), which are leaded to the cup-shaped inner recessed structure, at the periphery of the cup bottom surface (120) of the heat dissipater (100) where the electric luminous body (200) being installed, so with the characteristic of hot ascent/cold descent, the airflow near the cup bottom surface (120) of the heat dissipater (100) flows through the flow guide hole annularly arranged at the bottom periphery (301) and the cup-shaped inner recessed structure for dissipating heat to the exterior; (b) installing one or more flow guide holes (302), which axially penetrate the central column (103), at the center of the cup bottom surface (120) (as shown in FIG. 17); (c) installing one or more inclined flow guide holes at bottom corner (304) at the annular corner formed between the annular heat dissipater bottom of the heat dissipater (100) and the cup bottom surface (120).

According to the cup-shaped heat dissipater having heat conductive rib and flow guide hole and applied in electric luminous body of present invention, the central column (103) can further be composed of a solid central column;

FIG. 19 is a schematic structural view illustrating the central column (103) being composed as a solid central column, according to one embodiment of the present invention;

As shown in FIG. 19, the central column (103) of the present invention is formed as a solid structure.

Figure 20:
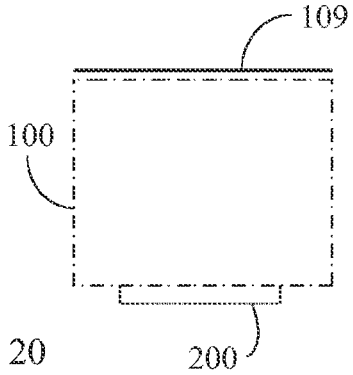
FIG. 20 is a schematic lateral view illustrating the top of the heat dissipater (100) opposite to the installation location of the electric luminous body (200) being additionally installed with a protection net (109), according to one embodiment of the present invention.

FIG. 20 is a schematic lateral view illustrating the top of the heat dissipater (100) opposite to the installation location of the electric luminous body (200) being additionally installed with a protection net (109), according to one embodiment of the present invention;

As shown in FIG. 20, according to one embodiment of the present invention, the top of the heat dissipater (100) opposite to the installation location of the electric luminous body (200) is additionally installed with the protection net (109).

Figure 21:
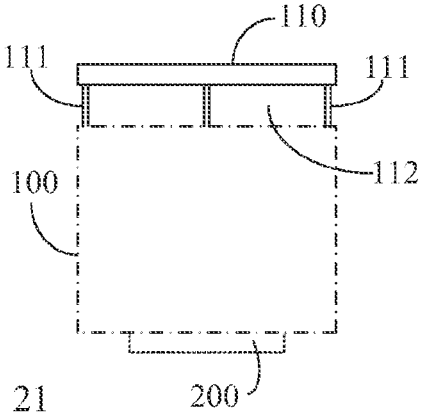
FIG. 21 is a schematic lateral view illustrating the top of the heat dissipater (100) opposite to the installation location of the electric luminous body (200) being installed with a top cover (110), and formed with a ventilation port (112) and a support column (111) served for combining and supporting between the top cover (110) and the heat dissipater (100), according to one embodiment of the present invention.

FIG. 21 is a schematic lateral view illustrating the top of the heat dissipater (100) opposite to the installation location of the electric luminous body (200) being installed with a top cover (110), and formed with a ventilation port (112) and a support column (111) served for combining and supporting between the top cover (110) and the heat dissipater (100), according to one embodiment of the present invention;

As shown in FIG. 21, according to one embodiment of the present invention, the top of the heat dissipater (100) opposite to the installation location of the electric luminous body (200) is installed with the top cover (110), and formed with the ventilation port (112) and the support column (111) served for combining and supporting between the top cover (110) and the heat dissipater (100).

Figure 22:
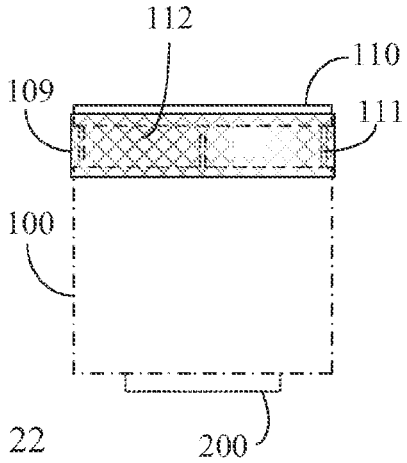
FIG. 22 is a schematic lateral view illustrating the support column (111) served for combining and supporting being installed between the top of the heat dissipater (100) opposite to the installation location of the electric luminous body (200) and the top cover (110), and the periphery of the ventilation port (112) being additionally installed with the protection net (109), according to one embodiment of the present invention.

FIG. 22 is a schematic lateral view illustrating the support column (111) served for combining and supporting being installed between the top of the heat dissipater (100) opposite to the installation location of the electric luminous body (200) and the top cover (110), and the periphery of the ventilation port (112) being additionally installed with the protection net (109), according to one embodiment of the present invention;

As shown in FIG. 22, according to one embodiment of the present invention, the support column (111) served for combining and supporting is installed between the top of the heat dissipater (100) opposite to the installation location of the electric luminous body (200) and the top cover (110), and the periphery of the ventilation port (112) is additionally installed with the protection net (109).

The mentioned electric luminous body (200) according to the cup-shaped heat dissipater having heat conductive rib and flow guide hole and applied in electric luminous body of present invention can further include being composed of the electric luminous body and optical component and lamp shade.

The invention claimed is:

1. A cup-shaped heat dissipater (100) for an electric luminous body (200), the electric luminous body being accommodated on an exterior surface of a bottom (120) of the cup-shaped heat dissipater (100), comprising:

a heat conductive rib structure (310) extending upwardly from an interior surface of the bottom (120) of the cup-shaped heat dissipater (100), said heat conductive rib structure (310) further extending laterally to an upwardly-extending outer periphery (101) of the cup-shaped heat dissipater (100) and forming one of: (i) a grid, and (ii) at least one central structure with radially extending connecting sections, wherein at least one flow guide hole is formed in the cup-shaped heat dissipater (100) to permit passage of air into the cup-shaped heat dissipater (100) and past surfaces of the heat conductive rib structure (310) to an exterior of the cup-shaped heat dissipater (100), said at least one flow guide hole having at least one of the following configurations:

(a) the at least one flow guide hole includes a plurality of flow guide holes (301) annularly arranged in the bottom (120) of the cup-shaped heat dissipater (100);

(b) the at least one flow guide hole includes at least one flow guide hole (302) at a center of the bottom (120) of the cup-shaped heat dissipater (100);

(c) the at least one flow guide hole includes at least one radially-extending flow guide hole (303) in the outer periphery (101) of the cup-shaped heat dissipater (100);

(d) the at least one flow guide hole includes at least one inclined flow guide hole at an edge of the bottom surface 120 of the cup-shaped heat dissipater (100).

2. A cup-shaped heat dissipater (100) as claimed in claim 1, wherein an upper annular surface of the outer periphery (101) of the heat dissipater (100) is planar.

3. A cup-shaped heat dissipater (100) as claimed in claim 1, wherein an upper annular surface of the outer periphery (101) of the heat dissipater (100) is formed with notches to form a wave-like surface.

4. A cup-shaped heat dissipater (100) as claimed in claim 1, wherein the heat conductive rib structure includes said at least one central structure, said at least one central structure being one of a tubular and a solid central column (103).

5. A cup-shaped heat dissipater (100) as claimed in claim 4, wherein an upper annular surface of the outer periphery (101) of the heat dissipater (100) is planar.

6. A cup-shaped heat dissipater (100) as claimed in claim 4, wherein an upper annular surface of the outer periphery (101) of the heat dissipater (100) is formed with notches to form a wave-like surface.

7. A cup-shaped heat dissipater (100) as claimed in claim 4, wherein the heat conductive rib structure includes at least one additional cylindrical structure between the central column (103) and the outer periphery (101) of the cup-shaped heat dissipater (100).

8. A cup-shaped heat dissipater (100) as claimed in claim 7, wherein upper annular surfaces of the outer periphery (101) and the additional annular structure of the heat dissipater (100) are planar.

9. A cup-shaped heat dissipater (100) as claimed in claim 7, wherein upper annular surfaces of the outer periphery (101)

and the additional annular structure of the heat dissipater (100) are formed with notches to form a wave-like surface.

10. A cup-shaped heat dissipater (100) as claimed in claim 7, wherein the cup-shaped heat dissipater (100) has a stepped structure in which the central column (103) extends further from the bottom surface (120) than the additional cylindrical structure, and the additional cylindrical structure extends from the bottom surface (120) than the outer periphery (101) of the cup-shaped heat dissipater (100).

11. A cup-shaped heat dissipater (100) as claimed in claim 4, wherein the cup-shaped heat dissipater (100) has a stepped structure in which the central column (103) extends further from the bottom surface (120) than the outer periphery (101) of the cup-shaped heat dissipater (100).

12. A cup-shaped heat dissipater (100) as claimed in claim 4, wherein the cup-shaped heat dissipater (100) has a stepped structure in which the outer periphery (101) extends further from the bottom surface (120) than the central column (103).

13. A cup-shaped heat dissipater (100) as claimed in claim 4, wherein the central column (103) is conical and the outer periphery (101) of the cup-shaped heat dissipater (100) is an annular structure (106) with vertically extending slots.

14. A cup-shaped heat dissipater (100) as claimed in claim 1, further comprising support columns (111) extending upwardly from an upper surface of the outer periphery (101) of the cup-shaped heat dissipater (100), a top cover (110) supported by the support columns (111), and ventilation openings (112) between the support columns (111), the upper surface of the outer periphery (101), and the top cover (110).

15. A cup-shaped heat dissipater (100) as claimed in claim 14, further comprising a protection net (109) installed at a top of the cup-shaped heat dissipater (100).

16. A cup-shaped heat dissipater (100) as claimed in claim 1, further comprising a protection net (109) installed at a top of the cup-shaped heat dissipater (100).

17. A cup-shaped heat dissipater (100) as claimed in claim 1, wherein the heat-conductive rib structure (310) is integral with the periphery (101) and bottom (120) of the cup-shaped heat dissipater (100).

18. A cup-shaped heat dissipater (100) as claimed in claim 1, wherein the heat-conductive rib structure (310) is assembled to the cup-shaped heat dissipater (100) as at least one separate piece.

19. A cup-shaped heat dissipater (100) as claimed in claim 1, wherein the heat-conductive rib structure (310) includes sheet-like structures.

20. A cup-shaped heat dissipater (100) as claimed in claim 1, wherein a material of the heat-conductive rib structure (310) is a material with high heat conductivity selected from aluminum and copper.

* * * * *